US007621237B2

(12) United States Patent
Krowech et al.

(10) Patent No.: US 7,621,237 B2
(45) Date of Patent: Nov. 24, 2009

(54) ECONOMIZER FOR A STEAM GENERATOR

(75) Inventors: Robert J. Krowech, Eden Prairie, MN (US); Edward B. Congdon, Eden Prarie, MN (US); Kevin M. Morales, Eden Prarie, MN (US)

(73) Assignee: HRST, Inc., Enden Prairie, MN (US)

( * ) Notice: Subject to any disclaimer, the term of this patent is extended or adjusted under 35 U.S.C. 154(b) by 143 days.

(21) Appl. No.: 11/892,306

(22) Filed: Aug. 21, 2007

(65) Prior Publication Data

US 2009/0050079 A1 Feb. 26, 2009

(51) Int. Cl.
*F22B 37/16* (2006.01)

(52) U.S. Cl. ..... 122/7 R; 122/235.23; 122/235.14

(58) Field of Classification Search ..... 122/7 R, 122/235.11, 235.14, 235.23, 459, 511
See application file for complete search history.

(56) References Cited

U.S. PATENT DOCUMENTS 3,267,914 A * 8/1966 Connell ..... 122/510
3,318,290 A * 5/1967 Gorzegno ..... 122/510
3,515,101 A * 6/1970 Unthank et al. ..... 122/365
3,703,161 A * 11/1972 O'Connor ..... 122/235.11
3,835,920 A * 9/1974 Mondt ..... 165/81
4,052,962 A * 10/1977 Dauthuille ..... 122/20 A
4,196,700 A * 4/1980 Keseru et al. ..... 122/406.1
4,430,962 A 2/1984 Miszak
5,419,285 A * 5/1995 Gurevich et al. ..... 122/406.1
6,019,070 A * 2/2000 Duffy ..... 122/209.1
6,055,803 A 5/2000 Mastronarde
6,186,221 B1 2/2001 Beauregard et al.
6,481,386 B2 11/2002 Wittchow
7,357,100 B2 * 4/2008 Waseda et al. ..... 122/511
2008/0282997 A1 * 11/2008 Gayheart et al. ..... 122/441

* cited by examiner

*Primary Examiner*—Gregory A Wilson
(74) *Attorney, Agent, or Firm*—Richard C. Litman

(57) ABSTRACT

An economizer for a heat recovery steam generator utilized to improve the efficiency of the Rankine cycle by preheating the water that flows to the evaporator section. The economizer multi-pass sections include up-flow tubes only. This arrangement greatly reduces thermal stresses on the tubes by ensuring that each individual tube in any fluid-flow pass operates at the same or similar temperature. The design of the invention does this by causing all tubes in any fluid-flow pass to have the same upwards fluid flow direction and similar fluid flow velocity. No unstable backflow (i.e. flow in the reverse direction) occurs in any of the tubes. Heated down-flow tube sections are totally eliminated in this design. Respective jumper pipes are provided to conduct the water from the top of an economizer panel to the bottom of an adjacent panel.

3 Claims, 4 Drawing Sheets

ECONOMIZER FOR A STEAM GENERATOR

BACKGROUND OF THE INVENTION

1. Field of the Invention

The present invention generally relates to heat transfer devices. More specifically, the present invention is drawn to an economizer unit for a heat recovery steam generator (HRSG).

2. Description of the Related Art

Maintaining the integrity of water tubes in heat recovery systems has been problematic in that the tubes are subjected to high mechanical stresses due to thermal expansion and contraction. Load changes, frequent stops and starts, water temperature differential, etc., all contribute to stresses that can lead to the degradation of the tubes. Leaking tubes usually require shutdown of the system so that the degraded tubes can be replaced. Such shutdowns obviously result in economic loss. Heretofore, attempted solutions to prolong the life of the tubes have included adding bends to the tubes, increasing the size and radius of existing bends, adding a re-circulation system or just accepting tube leaks and repairing them as they occur. These solutions have proven to be uneconomical, especially since leaks are not easily anticipated. The art would certainly welcome an uncomplicated and efficient economizer design that would alleviate the above discussed problems.

There are many economizer designs described in the related art. Pertinent examples of such related art are cited and described in the accompanying IDS. However, none of the above cited and described related art, taken either singly or in combination, is seen to disclose an economizer as will be subsequently described and claimed in the instant invention.

SUMMARY OF THE INVENTION

The present invention is a multi-pass economizer for a heat recovery steam generator, which economizer is utilized to improve the efficiency of the Rankine cycle by preheating the water that flows to the evaporator section of the steam generator. The economizer of the instant invention incorporates multi-pass sections comprising only up-flow tubes. The upflow only arrangement has been found to greatly reduce thermal stresses on the tubes by ensuring that each individual tube in any fluid-flow pass operates at the same or similar temperature. The design of the invention does this by causing all tubes in any fluid-flow pass to have the same upwards fluid flow direction and similar fluid flow velocity. Hydrostatic buoyancy pressures decrease flow stability in multi-circuit downflow tube sections, but it increases flow stability in up-flow sections. Therefore, no unstable backflow (i.e. flow in the reverse direction) occurs in any of the tubes. Heated downflow tube sections are totally eliminated in this design.

Accordingly, the invention presents an economizer, which economizer is efficient, uncomplicated in design and is able to better withstand thermal stress. The invention provides for improved elements thereof in an arrangement for the purposes described that are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
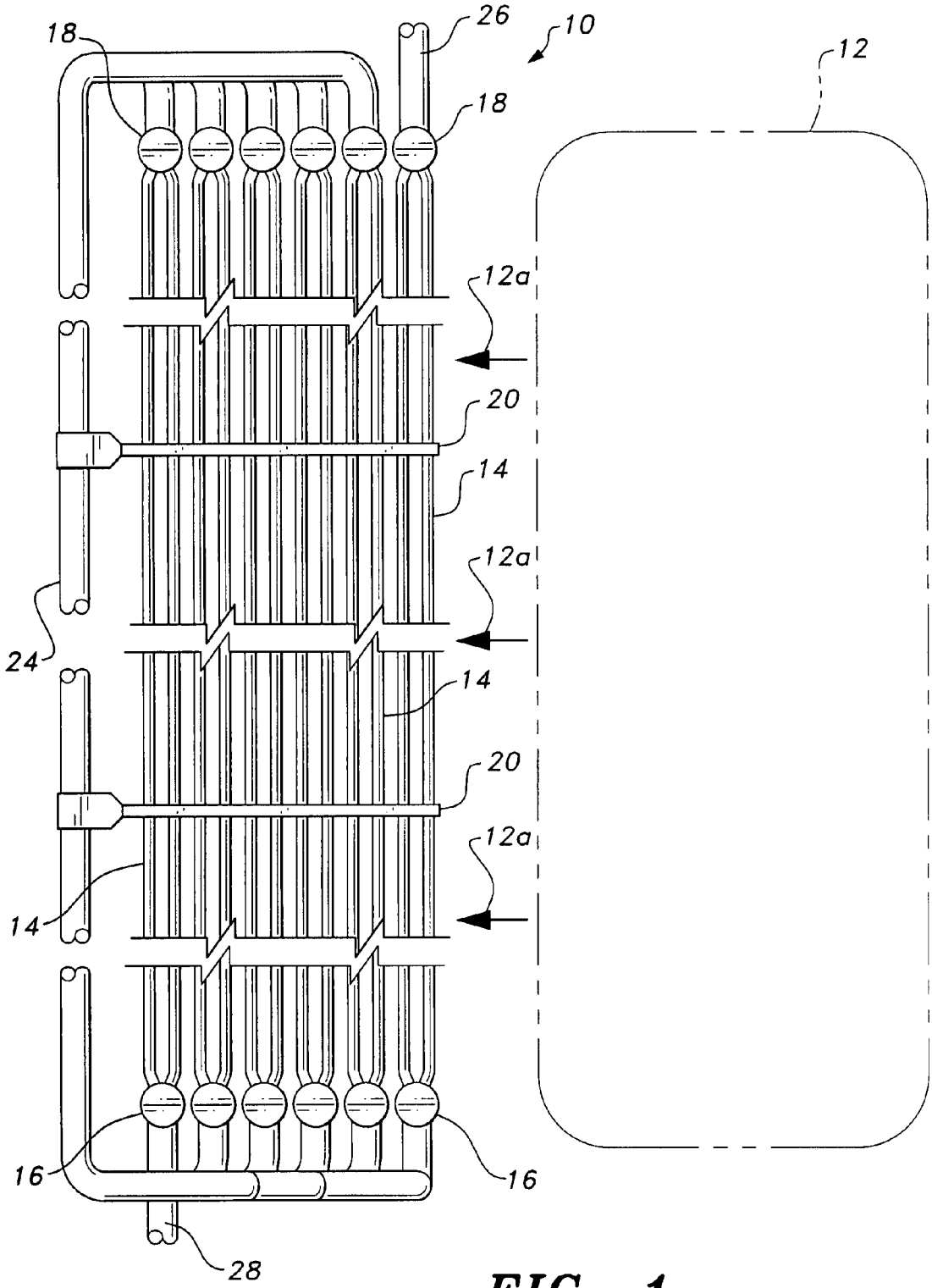
FIG. 1 is a partial, elevational, side view of an economizer for a heat recovery steam generator according to the present invention.
Figure 2:
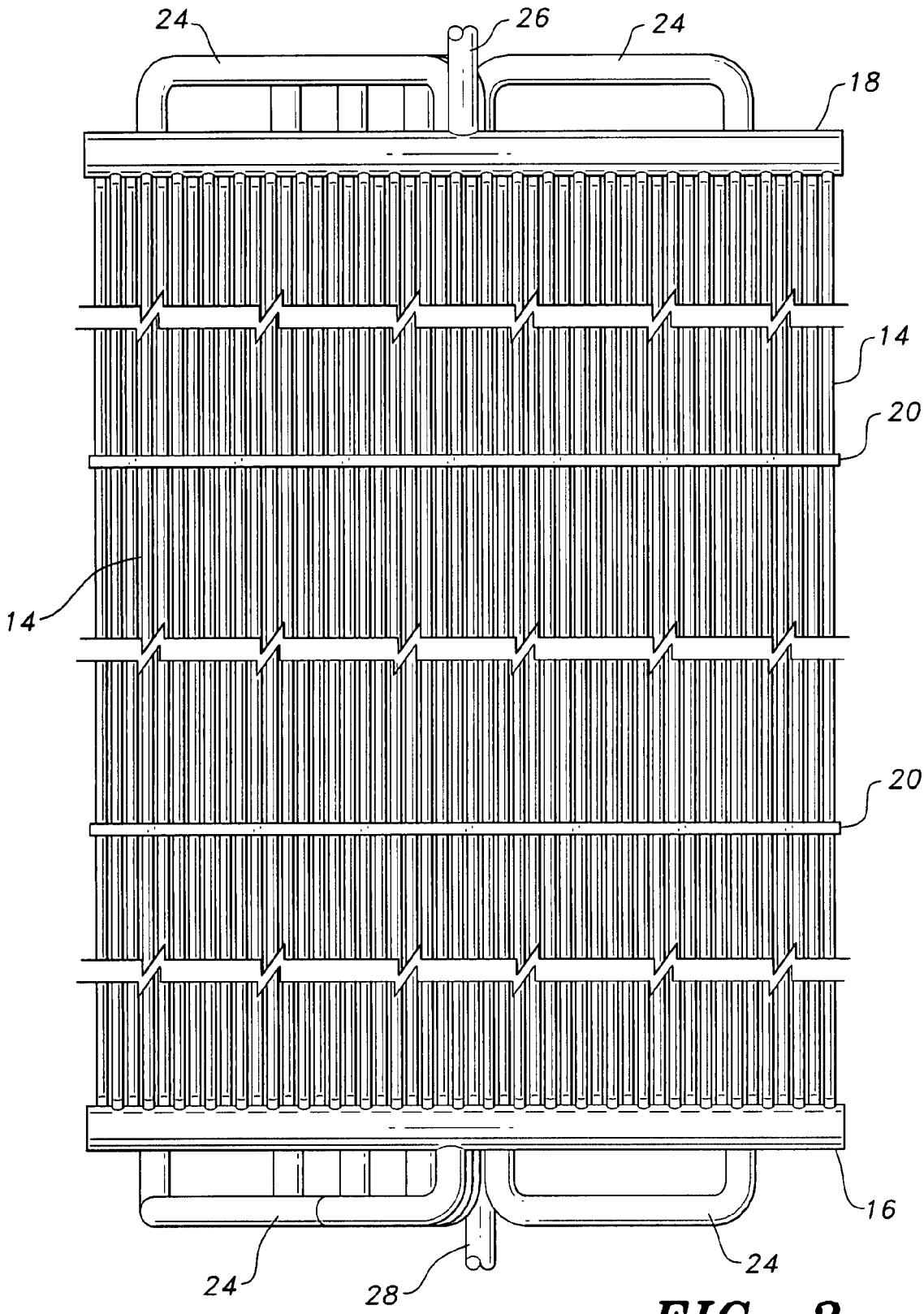
FIG. 2 is a partial, elevational, front view of an economizer for a heat recovery steam generator according to the present invention.

Attention is first directed to FIGS. 1 and 2 wherein the economizer of the present invention is generally indicated at 10 and is shown positioned downstream from a source of hot gas with a horizontal flow path 12 (indicated in phantom lines). Economizer 10 comprises an array of vertical tubes 14, which tubes extend perpendicularly from lower manifolds 16 to upper manifolds 18. Tubes 14 are secured in manifolds 16, 18 in a conventional manner and expand and contract when subjected to thermal changes caused by hot gas flow 12*a* on the outer surfaces and relatively cool water flow on the inner surfaces. The economizer is designed so that the water flow in the tube sections is in a vertically upward direction only. That is, water to be pre-heated flows from lower manifolds 16 upward into upper manifolds 18. Supports 20 are tied to tubes 14 and support tubes 14 in a horizontal orientation. Although illustrated with two tube ties, it is obvious that different steam generating installations could require more or fewer ties.

Figure 3:
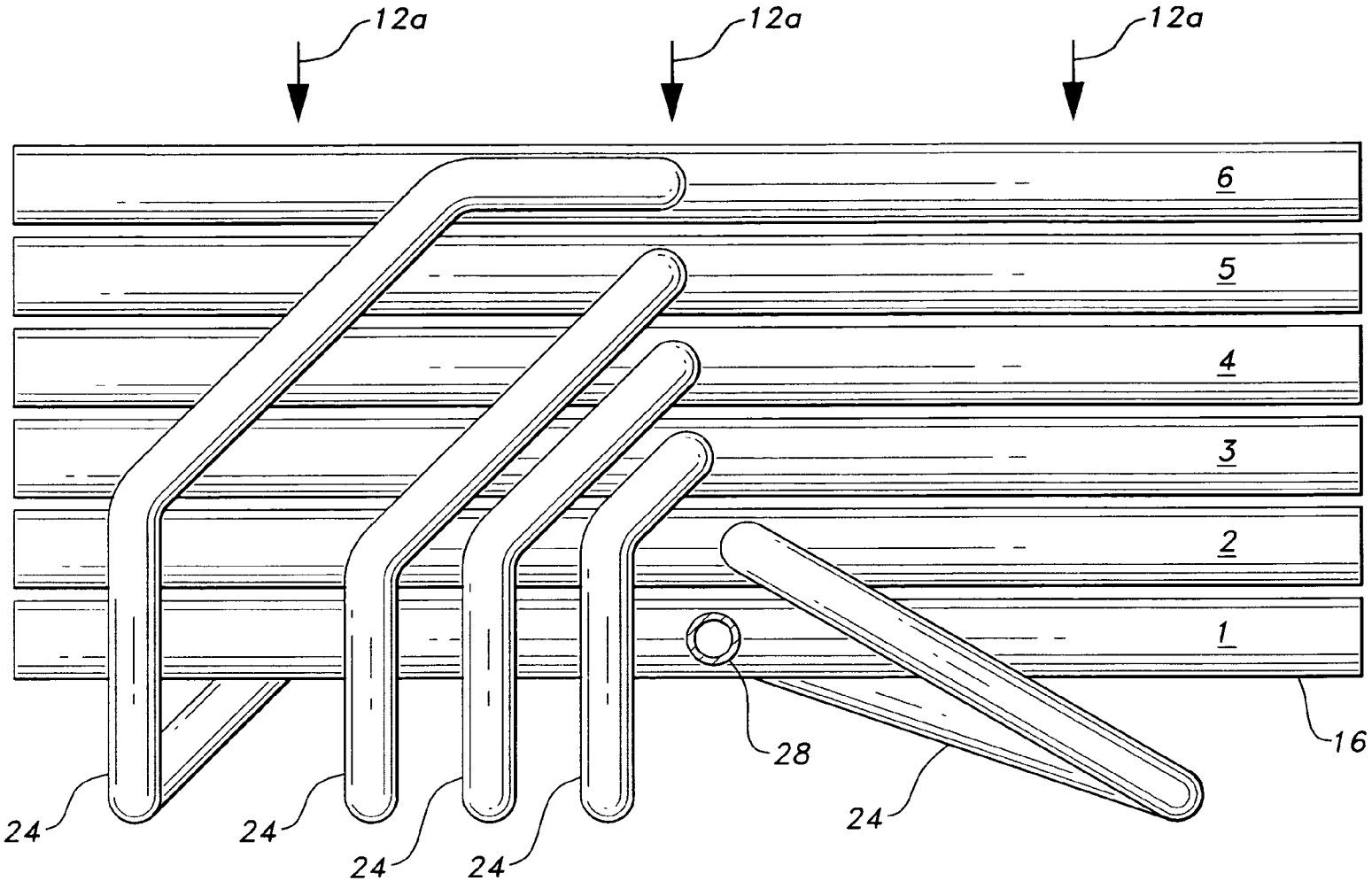
FIG. 3 is a partial, bottom view of an economizer for a heat recovery steam generator according to the present invention.
Figure 4:
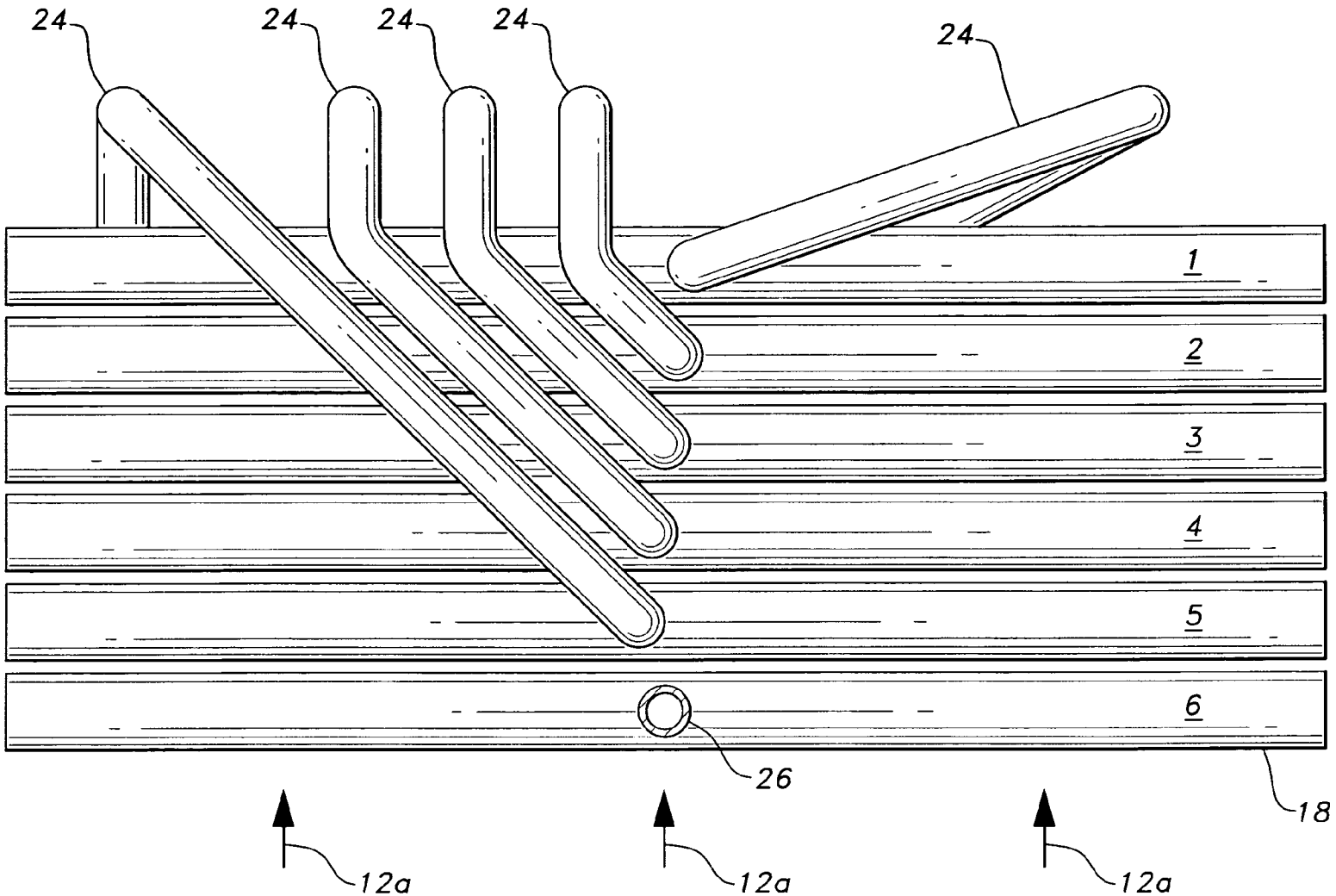
FIG. 4 is a partial, top view of an economizer for a heat recovery steam generator according to the present invention.

As best illustrated in FIGS. 3 and 4, tubes 14 are arranged in six panels, (numbered 1-6) each panel having forty-eight tubes. Each panel comprises an upper manifold a lower manifold and a bank of forty-eight tubes. A respective jumper pipe 24 connects respective upper and lower manifolds in each of five of the six panels. Supports 20 are also employed to stabilize jumper pipes 24. Panel 6 has its upper manifold connected with the economizer outlet 26. Panel 1 has its lower manifold connected with the economizer inlet 28.

In the above-described arrangement, water flow is always directed vertically upward in the tubes 14 of each panel and downward in each respective jumper pipe 24 in the multi-pass operation. Although illustrated with six panels, it is obvious that different steam generating installations could require more or fewer panels and/or tubes.

It is to be understood that the present invention is not limited to the embodiment described above, but encompasses any and all embodiments within the scope of the following claims.

We claim:

1. A multi-pass upflow economizer for a HRSG, comprising:

an array of heat transfer panels arranged in adjacent relationship;

each panel of said array comprising an upper manifold and a lower manifold positioned beneath said upper manifold;

an array of tubes connecting said upper manifold to said lower manifold of each respective panel, wherein said array of tubes extend in a perpendicular, vertical direction between said upper manifold and said lower manifold thereby providing flow in a vertically upward direction only;

a respective jumper pipe connecting the upper manifold of each respective panel of said array of heat transfer panels to respective lower manifold of an adjacent panel thereby recircuiting the total volume of flow between each heat transfer panel so that the flow in each of the tubes is upflow;

an economizer outlet connected to the upper manifold of one of the said array of panels; and an economizer inlet connected to the lower manifold of one of said array of panels.

2. The multi-pass economizer for a HRSG according to claim 1, wherein the array includes six panels and each panel comprises forty-eight tubes.

3. The multi-pass economizer for a HRSG according to claim 1, wherein support members stabilize each of the jumper pipes.

* * * * *